US005371126A

United States Patent [19]

Strickler

[11] Patent Number: 5,371,126

[45] Date of Patent: Dec. 6, 1994

[54] PROCESSING AID FOR PAPER MAKING

[75] Inventor: Ralph H. Strickler, Charlotte, N.C.

[73] Assignee: Sandoz Ltd., Basel, Switzerland

[21] Appl. No.: 47,864

[22] Filed: Apr. 14, 1993

[51] Int. Cl.[5] ..... C08K 5/34; D21H 21/16; D21H 23/04

[52] U.S. Cl. ..... 524/106; 162/158; 162/164.6; 162/199; 162/272; 162/276; 162/275; 524/98; 524/105; 524/800

[58] Field of Search ..... 548/354.1; 524/105, 524/106, 800, 98; 162/199, 272, 275, 276, 164.6, 158

[56] References Cited

U.S. PATENT DOCUMENTS 2,914,427 11/1959 Valko et al. ..... 528/342
3,259,572 7/1966 Dickson et al. ..... 252/8.5
3,617,440 11/1971 Strother ..... 162/164.6
3,639,642 2/1972 Matter et al. ..... 548/354.1

*Primary Examiner*—Veronica P. Hoke
*Attorney, Agent, or Firm*—Robert S. Honor; Richard E. Vila; Andrew N. Parfomak

[57] ABSTRACT

Aqueous compositions and process aids useful in paper processing for quenching optical brighteners, particularly under alkaline paper production conditions. The process aids are aqueous compositions comprising (a) an acid addition salt or quartenization product of a cyclic amidine, (b) a polyethyleneimine and optionally (c) an acid. The aqueous compositions and process aids may be added to paper feedstocks in paper production apparatus or to paper production apparatus absent a paper feedstock.

26 Claims, 4 Drawing Sheets

PROCESSING AID FOR PAPER MAKING

BACKGROUND OF THE INVENTION

The present invention relates to process aids useful in paper processing; more particularly the present invention relates to paper processing aids which are useful in quenching optical brighteners and fluorescent whitening agents.

DESCRIPTION OF THE PRIOR ART

The use of optical brighteners in organic substrates of natural or synthetic origin is well known. Such organic substrates include fibers ultimately used in paper products. Optical brightener compounds (also referred to as "optical brighteners") which are useful with such substrates include those indicated in the Color Index and include those which may be characterized as stilbenes. Whereas the inclusion of such optical brightener compounds is frequently desired in order to enhance the optical appearance of such organic substrates, the use of such optical brighteners is not always desired. One such instance is when paper is being produced on paper production apparatus and it is then desired to change the production to a different grade of paper which includes a different level of (or no) optical brightener. In a further instance it may be desired to produce new paper which is produced from a feedstock of previously brightened paper, such as where waste paper is used as a feedstock. Such waste paper may comprise varying amounts of optical brightener(s) included therein. Under these circumstances it is necessary to counteract the effect of any optical brighteners contained in the waste paper so to allow production of new paper. In such instances as have been just described it becomes frequently necessary to interrupt the production process so that the apparatus may be thoroughly cleaned, including the cleaning of any recirculation streams, surface coating slurries, size presses and the like so to remove optical brighteners therefrom. Such a cleaning process is time consuming and reduces the effective production capacity of the paper production process, an undesirable effect for both technical and economic considerations.

The prior art has proposed compounds which are indicated as processing aids which may be used to counteract or quench the effect of the optical brighteners present in waste paper feedstock and/or paper production apparatus. These compounds may be present in paper feedstock, such as when paper is recycled, are introduced into the paper production apparatus and act to quench the effect of any remaining optical brighteners in the paper production apparatus, as well as in any paper feedstock. Such compounds therefore tend to minimize the necessity of interrupting the paper producing apparatus to allow it to be thoroughly cleaned without the consequent loss of production capacity. However, such prior art compounds are not without their attendant shortcomings; many, such as the cyclic amidines described as "Constituent (a)" hereinafter are found to be most effective under acidic process conditions which limit their utility. They find use in the art as process aids which are advantageously introduced at an early point in the paper production process, typically at a paper pulper, broke chest or refiner. Recent advances in the art and consideration of environmental factors however favor the use of alkaline paper production processes which are known to produce paper products which are more stable over time than most products produced by acidic paper production processes. The prior art compound later described as "Constituent (b)" has been used as a drainage aid in the making of paper. It has been observed that these compounds, the polyethyleneimine polymers which are described as "constituent (b)" hereinafter have a quenching effect on optical brighteners but tend to undesirably yellow the resulting paper stock even at low dosages, such as 1–2 lbs. per ton of dry paper pulp. Further, such polyethyleneimine polymers have been observed to lose their quenching effectiveness with increasing dosages and have been further observed to contribute to optical brightness at higher dosages. They remain used in the art as a process aid and are conventionally added to a paper pulp at point in the paper production process immediately prior to the formation of paper from a paper pulp. Such a point may be at the fan pump wherein the final dilution of the paper pulp is produced, but is more typically at the head box(es) which are the feed source for paper forming screens.

Therefore it is among the objects of the present invention to provide compositions which are useful as process aids for counteracting the effect of optical brighteners, especially process aids which are useful under neutral or alkaline process conditions. A further object of the invention is to provide processes for counteracting the effect of optical brighteners which are present in substrates whether of naturally occurring or synthetic organic material, especially as might be present in paper pulps or waste paper both of which are useful as paper feedstocks.

A further object of the invention is realized in an improved process for the production of paper, which process includes the step of introducing a composition according to the invention for counteracting the effect of one or more optical brighteners during the paper production process.

A yet further object of the invention is to provide a flushing process and composition therefor useful in conjunction with apparatus and machinery, particularly useful in conjunction with paper production apparatus, which process includes the step of introducing a composition according to the invention for counteracting the effect of optical brighteners present therein.

SUMMARY OF THE INVENTION

Figure 1:
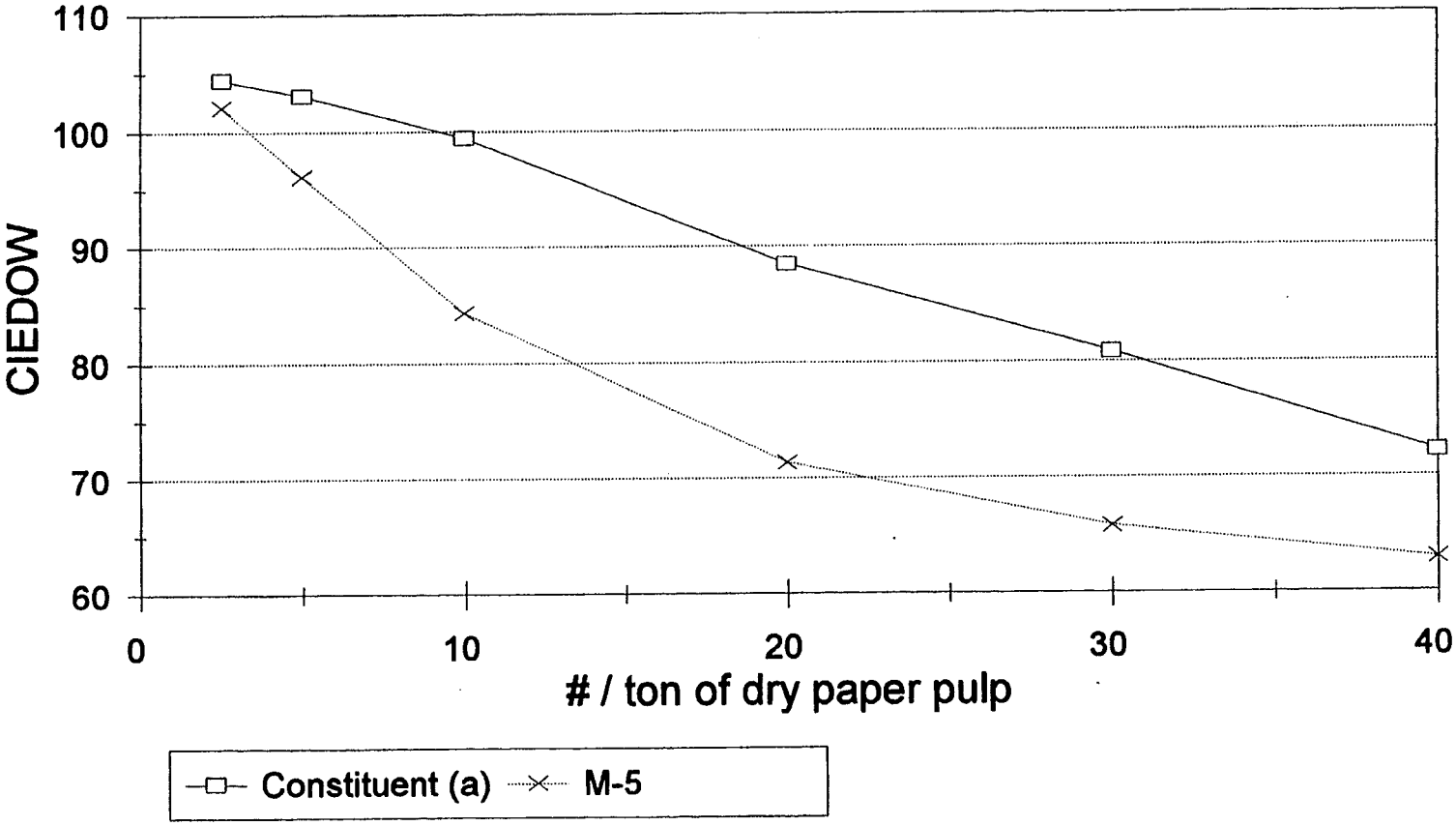
FIG. 1 illustrates comparative data of the degree of whiteness attained for compositions according to the invention and compositions according to the prior art under alkaline process conditions.

In one aspect, the present invention provides an aqueous composition which comprises constituents (a) and (b). The aqueous composition is particularly useful in quenching optical brighteners present in a paper feedstock as well as in paper production apparatus.

According to the invention, constituent (a) is (i): an acid addition salt or quartenization product of a cyclic amidine of Formula A.1

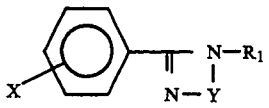

(A.1)

wherein:

Y is an alkylene chain having 2 to 4 carbon atoms, $R_1$ is hydrogen, or an alkyl, aryl and aralkyl group where such alkyl, aryl and aralkyl groups contain up to 7 carbon atoms, X is hydrogen, or a radical of Formula A.2:

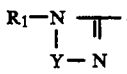

(A.2)

wherein $R_1$ and Y are as above defined, or constituent (a) may be:

ii): an acid addition salt or quartenization product of a polycondensation product containing two or more units which correspond to the compound of Formula A.3:

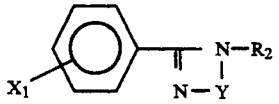

(A.3)

wherein Y is as defined above, $R_2$ is an alkylene chain with up to 8 carbon atoms and $X_1$is selected from the group consisting of:

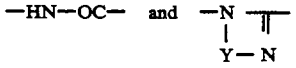

wherein

Y is as above defined.

Constituent (b) is a polyethyleneimine polymer, especially a polyethyleneimine homopolymer, as well as cationic, anionic, or amphoteric salts thereof.

Constituent (b) is preferably a polyethyleneimine polymer having the general structure according to Formula B.1:

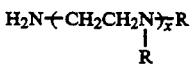

(B.1)

wherein x is 100–1,000,000, and each R is independently hydrogen or a structure according to the Formula B.2:

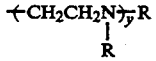

(B.2)

wherein y is 1–1,000,000 and each R is independently as above defined.

The aqueous compostions optionally but preferably further comprise a Constituent (c), an organic or inorganic acid which is added in at least an amount sufficient to cause the dissolution or dispersion of constituents (a) and (b) in water.

The aqueous compositions according to the invention have a pH of less than or equal to about 11, more usually between about 2 and 10 upon acid addition, and preferably are between about 3 and 8.

In a further aspect of the present invention there is provided a process for the treatment of paper feedstock which comprises the process step of:

adding an effective amount of the aqueous composition as described above, so to effectively quench paper feedstock, i.e., to neutralize the brightening effect of optical brighteners which are present in the paper feedstock, and which may also be present in paper production apparatus so to neutralize the effect of optical brighteners which may be entrained or otherwise present therein. The aqueous composition according to the invention may be used in paper production apparatus without paper feedstock being present, specifically as a cleaning or flushing composition to neutralize the effect of optical brighteners which may be entrained or otherwise present in paper production apparatus.

These and other objects of the invention will become more apparent from the following invention whose detailed description follows.

DETAILED DESCRIPTION OF THE INVENTION

Compositions according to the present invention are aqueous mixtures which comprise constituent (a) which may be (i): an acid addition salt or quartenization product of a cyclic amidine of Formula A.1

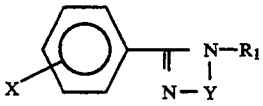

(A.1)

wherein:

Y is an alkylene chain having 2 to 4 carbon atoms, $R_1$ is hydrogen, or an alkyl, aryl and aralkyl group where such alkyl, aryl and aralkyl groups contain up to 7 carbon atoms, X is hydrogen, or a radical of Formula A.2:

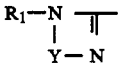

(A.2)

wherein $R_1$ and Y are as above defined, or constituent (a) may be:

ii): an acid addition salt or quartenization product of a polycondensation product containing two or more units which correspond to the compound of Formula A.3:

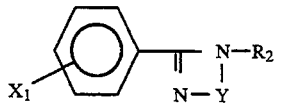

(A.3)

wherein Y is as defined above, $R_2$ is an alkylene chain with up to 8 carbon atoms and $X_1$ is selected from the group consisting of:

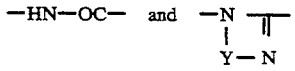

wherein Y is as above defined.

One or more acid addition salts and quarternization products of the compounds which are described as constituent (a) are encompassed in the present invention. Acid addition salts and quarternization products of the compounds corresponding to Formula A.1 are known to the art (see U.S. Pat. No. 3,639,642 herein incorporated by reference) and may, for example, be obtained by reacting the free cyclic amidines of Formula A.1 with an inorganic acid, for example hydrochloric or hydrobromic acid, phosphoric acid, sulphuric acid, sulphurous acid or carbonic acid, or an organic acid, such as an aliphatic or aromatic monocarboxylic or polycarboxylic acid including but not limited to: formic acid, acetic acid, propionic acid, oxalic acid, adipic acid, tartaric acid, citric acid, gluconic acid, benzoic acid, or one or more derivatives thereof. Further suitable acids include aliphatic or aromatic sulphonic acid, including but not limited to: methane sulphonic acid, ethanesulphonic acid, an alkanesulphonic acid of 3 to 20 carbon atoms, benzene-, methylbenzene- or naphtalenesulphonic acid, an alkylsulphuric acid of 1 to 20 carbon atoms, especially acetic acid, benzenesulphonic acid, 4-methylbenzenesulphonic acid, sulphuric acid or hydrochloric acid.

The quarternization products of the cyclic amidines of Formula A.1 may be produced by reacting a compound according to Formula A.1 or a corresponding polymer with, for example an alkyl-, cycloalkyl-, or aralkyl halide (of which the chloro-, bromo-, and iodohalides are preferred) or with the corresponding monoester or diester of sulphuric acid or the corresponding alkane-sulphonic acid ester, toluene-sulphonic acid ester or benzene-sulphonic acid ester or with an epoxide, such as ethylene oxide or propylene oxide. In the last mentioned case it is especially advantageous to start with a salt of a compound according to Formula A. 1 or to neutralize the quaternary base after reaction; the same acids as for the production of the addition salt of the compound of the Formula A.1 are suitable for this purpose. Suitable quarternization agents are, for example, butyl bromide, dodecyl bromide, fatty alkyl bromides, ethyl iodide, octa-decyl chloride, benzyl chloride, chloroacetamide, dimethyl sulphate, diethyl sulphate, sodium butyl sulphate, benzene-sulphonic acid, toluene-sulphonic acid methyl ester or toluene-sulphonic acid ethyl ester.

When a bifunctional quarternization agent is used, such as 1,2-dichloroethane, 1,2dibromoethane, 1,3-dichloropropane, 1,3-dibromopropane, 1,4-dichlorobutane, 1,4dibromobutane, 1 -bromo-3-chlorpropane, 1,3-dichloro-2-propanol, 3-chloro- 1,2-epoxypropane, 1,2-bis-(toluene-sulphonyloxy)-ethane, two molecules of the compound of the Formula A.1 may be linked to one another via the hydrocarbon residue of the quarternization agent.

The production of five-membered ring compounds, such as 2-arylene-1,3-diaza-2-cyclopentenes or 2-arylene-2-imidazioline) is described in U.S. Pat. No. 2,914,427. The six-membered rings, such as 2-arylene-1,3-diaza-2-cyclohexenes or 2-arylene-3,4,5,6-tetrahyropyrimidines, and the seven membered ring compound such as 2-arylene-1,3-diaza-2-cycloheptenes, may be produced in accordance with the process of Oxley and Short, Journal of the Chemical Society, London, 1947, at page 499.

Constituent (a) is preferably of the formula A.3 wherein $X_1$ is

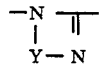

and wherein Y is ethylene.

The aqueous compositions according to the invention further comprise constituent (b) a polyethyleneimine polymer, as well as cationic, anionic, or amphoteric salts thereof.

Constituent (b) is a polyethyleneimine polymer, especially a polyethyleneimine homopolymer, as well as cationic, anionic, or amphoteric salts thereof.

Constituent (b) is preferably at least one polyethyleneimine polymer having the general structure according to Formula B.1:

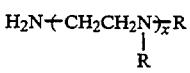

(B.1)

wherein x is 100–1,000,000, and each R is independently hydrogen or a structure according to the Formula B.2:

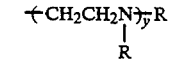

(B.2)

wherein y is 1–1,000,000 and each R is independently as above defined.

The polyethyleneimine polymer may be a straight chain or branched, but is preferably branched. Further, one or more polyethyleneimine polymers may be used as constituent (b) according to the present invention.

Useful polyethyleneimine polymers, especially polyethyleneimine homopolymers, as well as salts thereof may be of any molecular weight, however preferred are those having a weight average molecular weight of about 10,000 to about 100,000 with those having a weight average molecular weight of about 30,000 to about 80,000 being more particularly preferred.

The polyethyleneimine polymers may be obtained by a variety of means, for example by the controlled reaction of ethanolamine and ammonia under pressure over a fixed bed of a metal hydrogenation catalyst, from which may be obtained varying amounts of piperazine and the polyamine, as well as branched chain polyalkylene polyamine particularly useful in this invention. Additionally, the reaction products may be further polymerized to form the higher molecular weight polyethyleneimine polymers which are preferred for use in compositions according to the invention. This synthesis process is described in German Patent No. 14,480 (17 Mar. 1958); see also U.S. Pat. No. 3,259,572, whose contents are herein incorporated by reference. Many such polymers are specifically known and are presently commercially available including highly branched cationic polyethyleneimine polymers comprising more or less equal proportions of primary, secondary and tertiary amines.

The aqueous compositions according to the present invention optionally but preferably further comprise at least one (c) organic or inorganic acid which is added in an amount sufficient to cause the dissolution of constituents (a) and (b) in water. The acid which may be added to the aqueous compositions after constituents (a) and (b) have been combined in water so as to form a generally uniform aqueous composition. Alternatively, the acid may be added to one constituent prior to the addition of the other constituent. In a yet further alternative, one constituent may be mixed with water, after which the acid and the other constituent may be added to the mixture, in any order. It is to be understood that the order of addition of the acid is not critical to the operation of the invention. It is further to be understood that two or more acids may be incorporated into the mixtures of the present invention. By way of non-limiting example, useful inorganic acids include the mineral acids including: sulfuric, hydrochloric, hydrofluoric, phosphoric and boric acid, of which hydrochloric is most preferred. Useful organic acids include all organic acids; of these acetic acid is preferred. More preferably, the amount of acid included in the compositions according to the invention are sufficient to adjust the compositions to a pH at which the compositions exhibit good storage stability, usually a pH in the range of about 2 to 10, preferably a pH of about 3 to about 8, more preferably about 4 to 6½.

Variation in the inventive composition, particularly with respect to the quantity of water included is dependent upon the type of composition being made. It is contemplated that the composition may be produced in the concentrated form of a process aid preparation or process aid "concentrate"which is later intended to be further diluted with water prior to addition to an aqueous paper feedstock, or may be used directly without further dilution such as when a measured amount of process aid preparation is added to an aqueous paper feedstock. The concentration of constituents (a) and (b) in a process aid concentration may vary widely, and may be as little as about 1% by weight to as much as about 85% by weight, more usually from 5% to about 60% and preferably 10% to 50% by weight based upon the total weight of the process aid preparation.

It is to be understood that the order of addition of the constituents to form the aqueous compositions is not critical to the operation of the invention.

The proportions of constituents (a) and (b) may vary while retaining the benefits of the combination. On a weight basis the constituents (a) and (b) may be effectively combined in aa ratio in the range of (a):(b) of 10:1 to 1:3. In general, at least about 10 parts by weight constituent (a) is needed for every 1 part by weight of constituent (b) to enhance the effectiveness of both constituents. On the other hand, at least about 1 part of constituent (a) for every 3 parts of constituent (b) is required to offset the undesirable yellowing effects observed with constituent (b) alone and to substantially overcome the tendency of constituent (b) in diminishing its optical brightener quenching effectiveness with increasing dosages or increasing concentration of constituent (b). Preferably, the weight ratio of constituent (a): constituent (b) is in the range of 8.1 to 1:2, more preferably 6:1 to 1:1.5, and desirably in the range of 5:1 to 1:1, e.g., 3:1 to 1:1, and particularly 2:1.

It is contemplated that the constituents (a) and (b) as well as (c) prior to their mixing to form the aqueous compositions may individually be in the form of an aqueous dispersion. In such case a determination need be made of the total amount of solids contained in the dispersion, and based upon the solids weight, an appropriate weight ratio with further constituent(s) may be made and a composition according to the invention produced.

The inclusion of constitutent (c) in aqueous compositions has been observed to facilitate the mixing of the water and constituents (a) and (b) so to form a uniform mixture thereof and has further been observed to be beneficial in maintaining the stability of the aqueous compositions. The inclusion of an acid to adjust the pH of the process aid composition had been found to stabilize the composition especially as would be expected for storage periods such as those which would be expected in commercial use, i.e, 6 months to 18 months. It is further contemplated that a buffer may be added to maintain the pH level within a limited range to enhance shelf stability.

The invention may be used in counteracting or neutralizing the brightening effect of optical brighteners which are incorporated into the paper feedstock, and/or present in paper production apparatus so to neutralize their effect. The inventive compositions may be used either in a more concentrated form such as the process aid preparation hereintofore described, or may be used in a more dilute aqueous composition form. The inventive compositions may be used as a "cleansing agent" and added in aqueous composition form to the paper production apparatus, or may alternately be added to a process bath or process stream as a processing aid composition whereby which it may be further diluted. A paper feedstock need not be present. In a preferred embodiment an aqueous composition is introduced to the paper production apparatus by first adding the composition to a paper feedstock which is subsequently provided to the paper production apparatus. In accordance with this preferred embodiment the aqueous composition is mixed with the paper feedstock and acts to quench the optical brighteners present prior to the formation of sheets by the paper production apparatus. In such manner the benefits of quenching residual optical brighteners in a paper feedstock and in paper production apparatus may be simultaneously achieved, thereby allowing for rapid changes in paper feedstocks and/or paper grades such as during on-line production changes in a paper production mill.

The amounts of a composition according to the invention which is added to quench the effect of optical brighteners is to be understood to vary over a wide range. Such variation is due to one or more factors which include: type and concentration of brightening agent(s) present, the concentration of the aqueous composition according to the invention, or alternately, the degree of quenching desired. The amount of an aqueous composition may be determined by conventional empirical means for a particular process, such as by the removal of an alquoit of the optical brightener containing material and adding a sufficient aqueous composition to achieve a satisfactory level of quenching. Generally it has been observed that satisfactory quenching results may be achieved at dosages in the range of from 10 to 60 pounds, more usually 15 to 50 pounds of the aqueous composition per ton of paper feedstock on a "dry weight basis". A "dry weight basis" used with reference to a paper feedstock is to be understood as the dry weight of the paper forming constituents, (i.e., wood pulp, recycled paper) in a paper feedstock, or paper pulp.

Generally it has been observed that about 60 pounds and less of a 25–35% by weight solids (constituents (a) and (b)) content composition according to the invention per ton of paper pulp on a dry weight basis has been found to be effective. Preferably about 15–50 pounds 25–35% by weight solids content composition according to the invention per ton of paper pulp on a dry weight basis has been found to provide satisfactory quenching. Further particular examples are provided under the heading "Examples" below. Hence, based upon the dry weight of constituent (a) and (b) in the compositions according to the invention, satisfactory quenching effects have been in general achieved in the range of from 3 to 20 pounds dry weight of constituents (a) and (b) per ton of dry paper pulp. Particularly effective results are obtained at dosages in the range of from 4.5 to 15 pounds based on total dry weight, more particularly from 6 to 15 pounds of constituents (a) and (b) per ton of dry paper pulp.

The composition of the invention may be used in processes to quench optical brighteners or remove optical brighteners from paper making equipment essentially in the manner in which constituent (a) has been used in the art, subject to the above indicated dosages. The compositions of the present invention have been observed to be effective with conventional optical brighteners which are useful in the brightening of paper, especially stilbenes. Typically, it has been known to add constituent (a) to the pulper or broke chest where the concentration of solids in the paper pulp is higher than at most successive points in the paper production process prior to the formation of paper on paper screens. It is also contemplated that the composition of the invention may be used in the paper production process at a point after the formation of paper, especially at a size press. Such use facilitates rapid change of paper grades in the paper production apparatus. Paper pulp need not be present in the paper production apparatus in order to effect quenching of optical brighteners in the paper production apparatus.

In carrying out such processes it is not necessary to add a composition containing both constituents (a) and (b), rather constituents (a) and (b) may be co-added to paper pulp or the aqueous liquid in the paper production apparatus, i.e., added separately within the time frame indicated to obtain the benefits of the invention.

The invention is more easily understood by reference to specific embodiments which are representative examples according to the teachings of the instant invention. It must be understood however, that the specific embodiments discussed herein are provided only for the purpose of illustration, and not by way of limitation, and it is to be further understood that the invention may be practiced otherwise than specifically described and yet be within the inventive scope.

EXAMPLES

In the following examples, references to temperature are to be understood as to degrees Celsius (° C.), references to "part" or "parts" are to be understood as referring to parts by weight. References in the Tables and Figures to "dosages" or "pounds per ton of dry paper pulp" are to be understood as the pounds of a particular composition which is added per ton of paper pulp on a "dry weight basis" as has been described above.

Example A - Cyclic amidine (Constituent (a))

An amidine condensation product having predominantly cyclic structures is produced in accordance with the disclosure of U.S. Pat. No. 3,639,642 by initially reacting terephthalic acid dimethyl ester with triethylene tetramine in a polyethylene glycol solvent; the product is then quarternized with dimethyl sulphate. The amidine condensation product has a weight average molecular weight of approximately 10,000.

The amidine condensation product utilized in the examples was an aqueous mixture comprising approximately 25% –35% wt. amidine condensation product and the balance water.

Example B - Polyethyleneimine (Constituent (b))

A polyethyleneimine utilized was a commercially available polyethyleneimine polymer available from Sandoz Chemicals Corp. (Charlotte, N.C.) and characterized as having as highly branched cationic polymers comprising approximately 30% primary, 40% secondary and 30% tertiary amines and a molecular weight in excess of about 50,000.

The polyethyleneimine utilized in the examples described in more detail below was in an aqueous mixture comprising approximately 25%–35% wt. polyethyleneimine and the balance water.

Example M-1

To a 150 ml laboratory beaker into which was placed a magnetic stir bar was charged 75 gm of Constituent (a) and 25 gm of Constituent(b) as described above in reference to Example A and Example B. The beaker was placed on a magnetic stirrer pad and activated to agitate the contents of the beaker for approximately one minute at which point were added 2.5 grams of glacial acetic acid and stirring continued for approximately 5 minutes to form a uniform liquid. The contents of the beaker was removed and bottled for later use; pH was determined to be 8.68.

Example M-2

To a 150 ml laboratory beaker into which had been placed a magnetic stir bar was charged 25 gm of Constituent (b). The beaker was placed on the magnetic stirrer pad and activated to agitate the contents of the beaker for approximately one minute at which point 5 ml of glacial acetic acid was added. The mixture was agitated for a further 3–4 minutes after which 75 grams of Constituent (a) was added and stirring continued for several minutes until the liquid mixture appeared uniform by unaided visual inspection. The contents of the beaker was then bottled for later use; pH was determined to be 7.0.

Example M-3

To a 150 ml laboratory beaker into which had been placed a magnetic stir bar was charged 25 gm of Constituent (b). The beaker was placed on the magnetic stirrer pad and activated to agitate the contents of the beaker for approximately one minute after which time 2.5 grams of glacial acetic acid were added, and subsequently was then added 75 gm Constituent (a). The contents of the beaker were stirred until the mixture appeared uniform by unaided visual inspection. The contents of the beaker was then withdrawn and bottled for later use; pH was determined to 8.5.

Example M-4

To a 150 ml laboratory beaker containing a magnetic stir bar was charged 25 gm of Constituent (b). The beaker was placed on the magnetic stirrer pad and activated to agitate the contents of the beaker. After approximately one minute of stirring 7.5 grams of glacial acetic acid were added, followed by 75 gm of Constituent (a). Stirring of the beaker contents continued for a further 5 minutes at which point the mixture appeared uniform. The contents of the beaker were withdrawn and bottled for later use; pH was determined to be 5.1.

Example M-5

To a 150 ml laboratory beaker containing a magnetic stir bar was charged 40 gm of Constituent (b), followed by 12 gm of glacial acetic acid and 8 gm deionized water. The beaker was placed on the magnetic stirrer pad and activated to agitate the contents of the beaker for approximately one minute at which point the mixture appeared uniform. To the beaker was then added 40 gm Constituent (a) and stirring continued for a further 15 minutes. The liquid was then withdrawn and bottled for later use; pH was determined to be 5.1. The bottled liquid was evaluated 207 days later and the pH was determined to be 5.1.

Example M-6

To a 150 ml laboratory beaker containing a magnetic stir bar was charged 40 gm of Constituent (b). The beaker was placed on the magnetic stirrer pad and activated to agitate the contents of the beaker. While stirring 20 gm of aqueous hydrochloric acid (technical grade, 38%) was slowly added to the beaker. The temperature was noted to rise to approximately 65° C. The mixture was then allowed to further continue stirring for several minutes, at which time 40 gm of Constituent (a) liquid was added. The mixture was agitated for several minutes further until the contents were uniform in appearance. The contents of the beaker were then removed and bottled for later use; pH was determined to be 4.5. The bottled liquid was evaluated 102 days later and the pH was determined to be 4.2.

Example M-7

To a 150 ml laboratory beaker into which had been placed a magnetic stir bar was charged 40 gm of Constituent (b). The beaker was placed on the magnetic stirrer pad and activated to agitate the contents of the beaker. While stirring, 13 gm of aqueous hydrochloric acid (technical grade, 38%) was slowly added to the beaker. The temperature was noted to rise to approximately 65° C. The mixture was then allowed to continue stirring for several minutes further during which period 3 gm of deionized water was added followed by 40 gm of Constituent (a). Subsequently during continued stirring 4 gm of glacial acetic acid was added. The mixture was agitated for several minutes until the contents were uniform in appearance. The pH was determined to be 4.95. The contents of the beaker was then bottled for later use. The bottled liquid was evaluated 102 days later and the pH was determined to be 4.8

Example M-8

To a 150 ml laboratory beaker into which had been placed a magnetic stir bar was charged 75 gm of Constituent (b). The beaker was placed on the magnetic stirrer pad and activated to agitate the contents of the beaker. While stirring, 35.6 gm of aqueous hydrochloric acid (technical grade, 38%) was slowly added in a dropwise fashion to the beaker by means of an eyedropper. The temperature was noted to rise to approximately 70° C. The mixture was then allowed to continue stirring for several minutes further, after which 25 gm of Constituent (a) was added in a dropwise fashion to the stirring mixture by means of a further eyedropper. The temperature was noted to fall to approximately 54° C. The mixture was further stirred for several minutes (3–5 minutes) until the contents were uniform in appearance. The contents of the beaker was then bottled for later use.

Example M-9

To a 150 ml laboratory beaker into which had been placed a magnetic stir bar was charged 80 gm of Constituent (b). The beaker was placed on the magnetic stirrer pad and activated to agitate the contents of the beaker. While stirring, 38 gm of aqueous hydrochloric acid (technical grade, 38%) was slowly added in a dropwise fashion to the beaker by means of an eyedropper. The temperature was noted to rise to approximately 70° C. The mixture was then allowed to continue stirring for several minutes further, after which 20 gm of Constituent (a) was added in a dropwise fashion to the stirring mixture by means of a further eyedropper. The mixture was further stirred for several minutes (3–5 minutes) until the contents were uniform in appearance. The contents of the beaker was then bottled for later use.

Example M- 10

To a 150 ml laboratory beaker equipped with a magnetic stir bar was charged 25 gm of Constituent (b). The beaker was placed on the magnetic stirrer pad and activated to agitate the contents of the beaker. While stirring, 12 gm of aqueous hydrochloric acid (technical grade, 38%) was slowly added in a dropwise fashion to the beaker by means of an eyedropper. The temperature was noted to rise to approximately 70° C. The mixture was then allowed to continue stirring for several minutes further, after which 75 gm of Constituent (a) was added in a dropwise fashion to the stirring mixture by means of a further eyedropper. The mixture was further stirred for several minutes (3-5 minutes) until the contents were uniform in appearance. The contents of the beaker was then bottled for later use.

Example M- 11

Into a 150 ml laboratory beaker equipped with a magnetic stir bar was charged 20 gm of Constituent (b). The beaker was placed on the magnetic stirrer pad and activated to agitate the contents of the beaker. While stirring, 9.5 gm of aqueous hydrochloric acid (technical grade, 38%) was slowly added in a dropwise fashion to the beaker by means of an eyedropper. The mixture was then allowed to continue stirring for several minutes further to assure good mixing of the beaker contents. The beaker was removed from the magnetic stirrer pad and 100 gm of Constituent (a) was added to beaker. The beaker was replaced on the magnetic stirrer pad and the mixture was further stirred for several minutes until the contents were uniform in appearance. The contents of the beaker was then bottled for later use.

Example M- 12

Into a 150 ml laboratory beaker equipped with a magnetic stir bar was charged 15 gm of Constituent (b). The beaker was placed on the magnetic stirrer pad and activated to agitate the contents of the beaker. While stirring, 7 gm of aqueous hydrochloric acid (technical grade, 38%) was slowly added in a dropwise fashion to the beaker by means of an eyedropper. The mixture was then allowed to continue stirring for several minutes further to assure good mixing of the beaker contents. The beaker was removed from the magnetic stirrer pad and 90 gm of Constituent (a) was added to beaker. The beaker was replaced on the magnetic stirrer pad and the mixture was further stirred for several minutes until the contents were uniform in appearance. The contents of the beaker was then bottled for later use.

The aqueous mixtures produced according to Examples M-1 through M-3 demonstrate aqueous compositions according to the invention. The aqueous mixtures according to Examples M-4 through M-12 provide examples of processing aid preparations.

Production of Paper Samples

Evaluation of the aqueous mixture compositions according to Examples M-1 through M-7 were performed in accordance with the following general procedure.

Paper feedstock was produced in sample lots of 600 grams of an air dried blend of paper pulp were formed from 70% wt bleached short-fiber hardwood kraft pulp and 30% wt bleached long-fiber softwood kraft pulp. The sample lots were combined with 24 liters of water and stirred to defiber them to a 2.5% consistency. The sample lots contained 2.5% by weight pulp and the balance water. The defibred pulp was subsequently introduced into a Hollander beater to further refine and mix the pulps; refinement was carried out until the pulp satisfied Canadian Standard 400 freeness value (a measurement of the rate of drainage of water). The sample lots were then removed, and an alquoit which contained 400 grams of pulp on an air dried basis was then placed into a stainless steel bucket. During stirring was added 3.8 grams of calcium chloride ($CaCl_2$) so to establish a concentration level of 200 parts per million of $CaCO_3$, and 2 grams of sodium bicarbonate ($NaHCO_3$) so to establish the alkalinity to 150 parts per million of $CaCO_3$. To the contents of the bucket were then added 4 grams of a commercial strength composition of a stillbene based optical brightener composition, LEUCOPHOR ® B-302 liquid (Color Index Fluorescent Whitener 220). The dosage of the optical brightener composition was equal to 20 lbs. optical brightener composition per ton of dry paper pulp. The contents of the bucket were stirred for 30 minutes at room temperature to ensure thorough mixing.

Subsequently, 200 ml aliquots were removed and provided into laboratory beakers; these 200 ml aliquots generally contained sufficient solids to form a 5 gm sheet of paper therefrom. To each of the beakers were then added one of the compositions according to Examples M- 1 through M- 10, or one of the comparative compositions ("control" compositions), in an amount equal to dosage levels of 2.5, 5, 10, 20, 30 or 40 lbs. of aqueous composition per ton dry paper pulp and which are reported with the individual tests and corresponding results reported below. The beakers were then stirred under mechanical agitation for a period of 20 minutes at room temperature (approx. 20° C.) so to ensure thorough distribution of the added composition to be evaluated. Subsequently the contents of the beakers were then provided to a laboratory standard 8 inch by 8 inch sheet forming mold (Williams Co., Waterford, N.Y.) and further diluted in the mold with sufficient additional water so to produce an aqueous paper pulp having a concentration of 5 gm dry pulp per 2 liters liquid. By the addition of this water to the compositions provided to the sheet forming mold it was noted that the pH levels were in the range of approximately 7½–8 prior to the formation of the sheet on the screen of the sheet forming mold; this pH level is representative of the "wire pH" which is understood in the paper manufacture art as the incident pH of a paper feedstock which is imminently to be provided to or at the paper forming screens (or other paper forming means) during a paper production process. A sheet was formed in the mold by allowing the liquids to drain from the mold, and after sufficiently formed the sheet was manually removed from the mold, inserted between two dry blotter sheets and pressed in a 9 inch by 9 inch press at an operating pressure of approximately 600 psi for approximately 60 seconds. The formed sheet was then removed from the press and the blotter sheets and then placed between two further blotter sheets and then inserted into a photographic drum-type dryer wherein the formed sheet and the blotter sheets were held against a smooth polished metal platen which was heated by electrical resistance element heaters by the action of a fabric covering sheet for a sufficient time to evaporate 98+% of any liquids in the formed sheet. The formed 8 inch by 8 inch sheet was removed from the drum-type dryer and from between the blotter sheets and was ready for evaluation in accordance with one or more of the tests outlined following.

Evaluation of Paper Samples

Each of the paper samples formed were evaluated to determine one or more of the following characteristics:

CIE Degree of Whiteness (also referred to as "CIEDOW"): Evaluation of paper samples were performed utilizing a ACS-CS5 Spectrophotometer (Datacolor International Co. ) utilizing a type D65 light source (6500° K., ultraviolet corrected to simulate daylight) and measuring a 10° reflected light angle; the ACS-CS5 Spectrophotometer reported output data were in a scale of 0–200. The CIEDOW provides a useful index from which the efficacy of a quenching composition, may be compared and contrasted with other paper samples.

I. Evaluation of Composition M-5 and Comparison Compositions

Plural evaluative samples were made in accordance with the general procedure outlined above under the heading "Production of Paper Samples" utilizing the aqueous composition M-5 as well as one comparative composition known in the art. The first of these comparative compositions is the amidine condensation product used in M-5 and also identified as Constituent (a). Constituent (a) was used as an aqueous composition which comprised 29–32% wt. of the quarternized cyclic amidine condensation product.

Plural paper samples were produced at alkaline pH's in the range of about 7½–8 according to the protocol outlined under the heading "Production of Paper Samples" so to evaluate the dosages of the various compositions at levels equivalent to 2.5 lbs. of an aqueous quenching composition per ton of paper pulp on a dry weight basis. Similarly, levels of 5 lbs./ton dry paper pulp, 10 lbs./ton dry paper pulp, 20 lbs./ton dry paper pulp, 30 lbs./ton dry paper pulp and 40 lbs./ton dry paper pulp were likewise evaluated. Testing procedures were carried out in accordance with the protocol outlined under the heading "Evaluation of Paper Samples" under alkaline conditions, specifically under pH levels of 7½–8 so to determine the efficacy of the inventive composition under alkaline conditions relative to other compositions known to the art. The pH levels of 7½–8 closely approximate wire pH of the paper production process. The results of these evaluations are outlined in Table 1 below.

TABLE 1

| Product: | CIEDOW | LB/TON |
|---|---|---|
| Constituent (a) | 104.48 | 2.5 |
| M-5 | 102.17 | 2.5 |
| Constituent (a) | 103.11 | 5 |
| M-5 | 96.18 | 5 |
| Constituent (a) | 99.5 | 10 |
| M-5 | 84.36 | 10 |
| Constituent (a) | 88.56 | 20 |
| M-5 | 71.43 | 20 |
| Constituent (a) | 80.86 | 30 |
| M-5 | 65.79 | 30 |
| Constituent (a) | 72.22 | 40 |
| M-5 | 62.92 | 40 |

The results of Table 1 are graphically indicated on accompanying FIG. 1 which illustrates the relative reduction in whiteness as indicated by lower CIE Degree of Whiteness ("CCIEDOW") readings obtained.. With reference to FIG. 1, it is to be observed that the inventive composition as exemplified by Example M-5 provided superior quenching effectiveness throughout the complete dosage range from 2.5 to 40 lbs. composition per ton of dry paper pulp as exemplified by low CIEDOW readings. The composition of Example M-5 provided distinctly better quenching at equivalent dosages under alkaline process conditions than the comparative compositions.

II. Evaluation of Composition M-5 and Comparative Compositions

Evaluative paper samples were made in accordance with the general procedure outlined above under the heading "Production of Paper Samples" except for the following changes: as a source of paper feedstock was used defibred photocopier paper which was already refined and which comprised optical brightening agents known the art; the photocopier paper was reduced to a brightened broke which was sufficiently refined to Canadian Standard freeness value of 400, and then processed further in accordance with the protocol described under the heading "Production of Paper Samples" except that no optical brighteners were added in any step. The aqueous composition identified as "M-5" as well as the a comparative composition which consisted essentially of the quarternized cyclic amidine identified as Constituent (a) above in an aqueous mixture which comprised 29–32 % wt. of the quarternized cyclic amidine known were evaluated. Plural paper samples were produced to evaluate the dosages of the various compositions at levels equivalent to 2.5, 5, 10, 20, 30 and 40 lbs. of a quenching compositions per ton of dry paper pulp.

Plural paper samples were produced at alkaline pH's in the range of 7½–8½ according to the protocol outlined under the heading "Production of Paper Samples" so to evaluate the dosages of the various compositions at levels equivalent to 2.5 lbs. of a quenching composition per ton of dry paper pulp on a weight basis. Similarly other dosages were evaluated including 5 lbs./ton dry paper pulp, 10 lbs./ton dry paper pulp, 20 lbs./ton dry paper pulp, 30 lbs./ton dry paper pulp and 40 lbs./ton dry paper pulp. Testing procedures were carried out in accordance with the protocol outlined under the heading "Evaluation of Paper Samples" to determine the relative efficacy of the quenching compositions under alkaline conditions, specifically under pH levels of 7½–8½ which correspond to "wire pH" levels. The results of these evaluations are outlined in Table 2 below.

TABLE 2

| Product: | CIEDOW | LB/TON |
|---|---|---|
| Constituent (a) | 106.25 | 2.5 |
| M-5 | 103.76 | 2.5 |
| Constituent (a) | 104.37 | 5 |
| M-5 | 101.05 | 5 |
| Constituent (a) | 99.9 | 10 |
| M-5 | 91.4 | 10 |
| Constituent (a) | 92.95 | 20 |
| M-5 | 80.28 | 20 |
| Constituent (a) | 80.16 | 30 |
| M-5 | 72.24 | 30 |
| Constituent (a) | 71.54 | 40 |
| M-5 | 65.53 | 40 |

Figure 2:
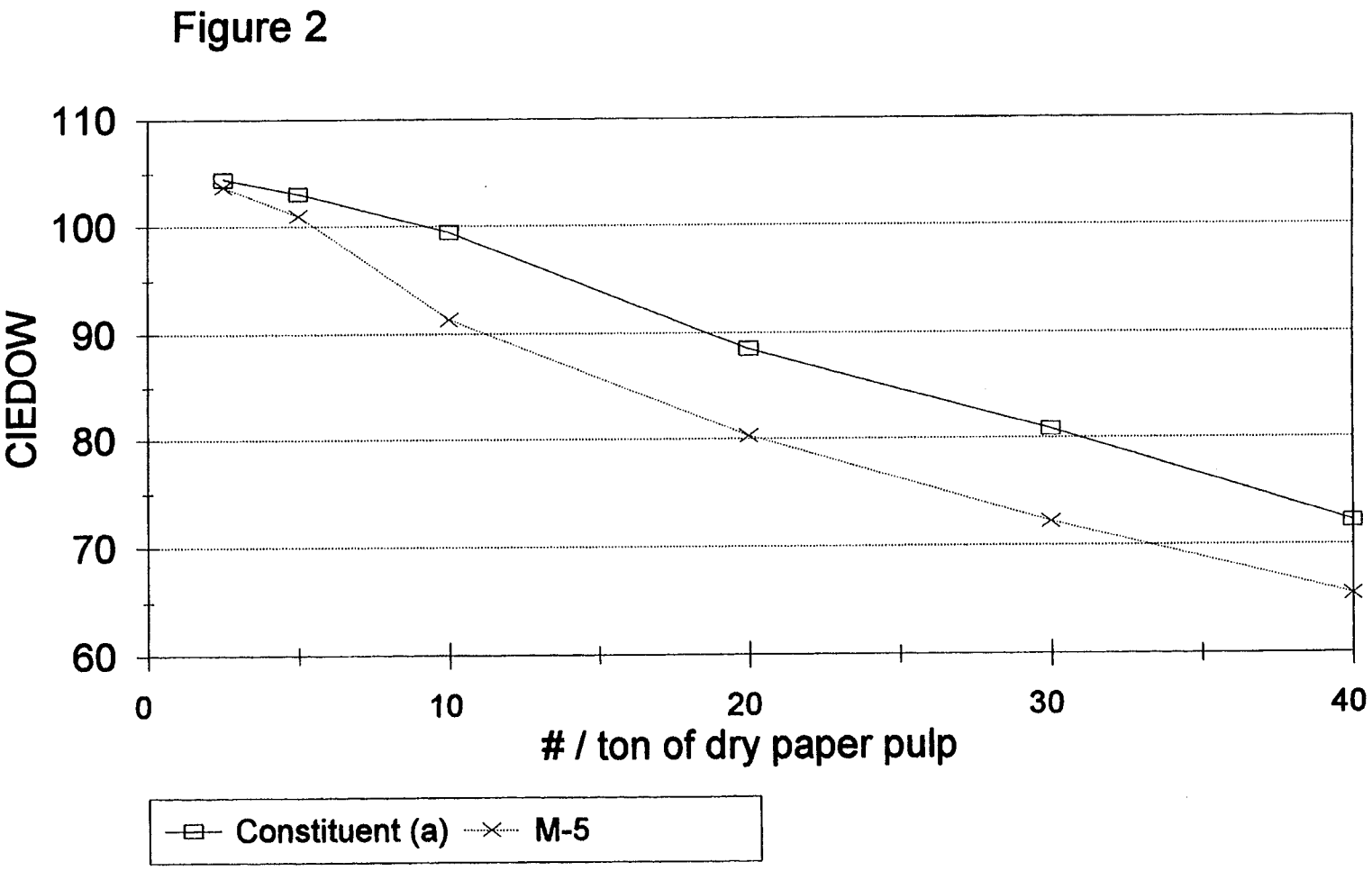
FIG. 2 illustrates comparative data of the degree of whiteness attained for compositions according to the invention and compositions according to the prior art under alkaline process conditions.

The results of Table 2 are indicated on accompanying FIG. 2 which illustrates the relative efficacy of the inventive compositions as exemplified by Example M-5 compared with Constituent a in quenching conventional optical brighteners in a repulped paper used as a paper feedstock under alkaline process conditions.

III. Evaluation of Compositions M-5 and M-6

Plural evaluative samples were made in accordance with the general procedure-8½ outlined above under the heading "Production of Paper Samples" utilizing the aqueous compositions according to M-5 and M-6. The comparison was performed to investigate compositions comprising acetic acid and those comprising hydrochloric acid. The wire pH of the paper samples were in the range of 7½–8½ according to the protocol outlined under the heading "Production of Paper Samples" so to evaluate the dosages of quenching compositions the various compositions at weight percentage levels equivalent to 2.5, 5, 10 and 20 lbs. of aqueous quenching composition per ton dry paper pulp. Testing procedures were carried out in accordance with the protocol outlined under the heading "Evaluation of Paper Samples" to determine the efficacy of the inventive composition under alkaline process conditions; the results of these evaluations are outlined in Table 3 below.

TABLE 3

| Product: | CIEDOW | LB/TON |
|---|---|---|
| M-5 | 122.18 | 2.5 |
| M-6 | 123.3 | 2.5 |
| M-5 | 107.26 | 5 |
| M-6 | 105.88 | 5 |
| M-5 | 83.64 | 10 |
| M-6 | 83.08 | 10 |
| M-5 | 106.25 | 20 |
| M-6 | 105.81 | 20 |

Figure 3:
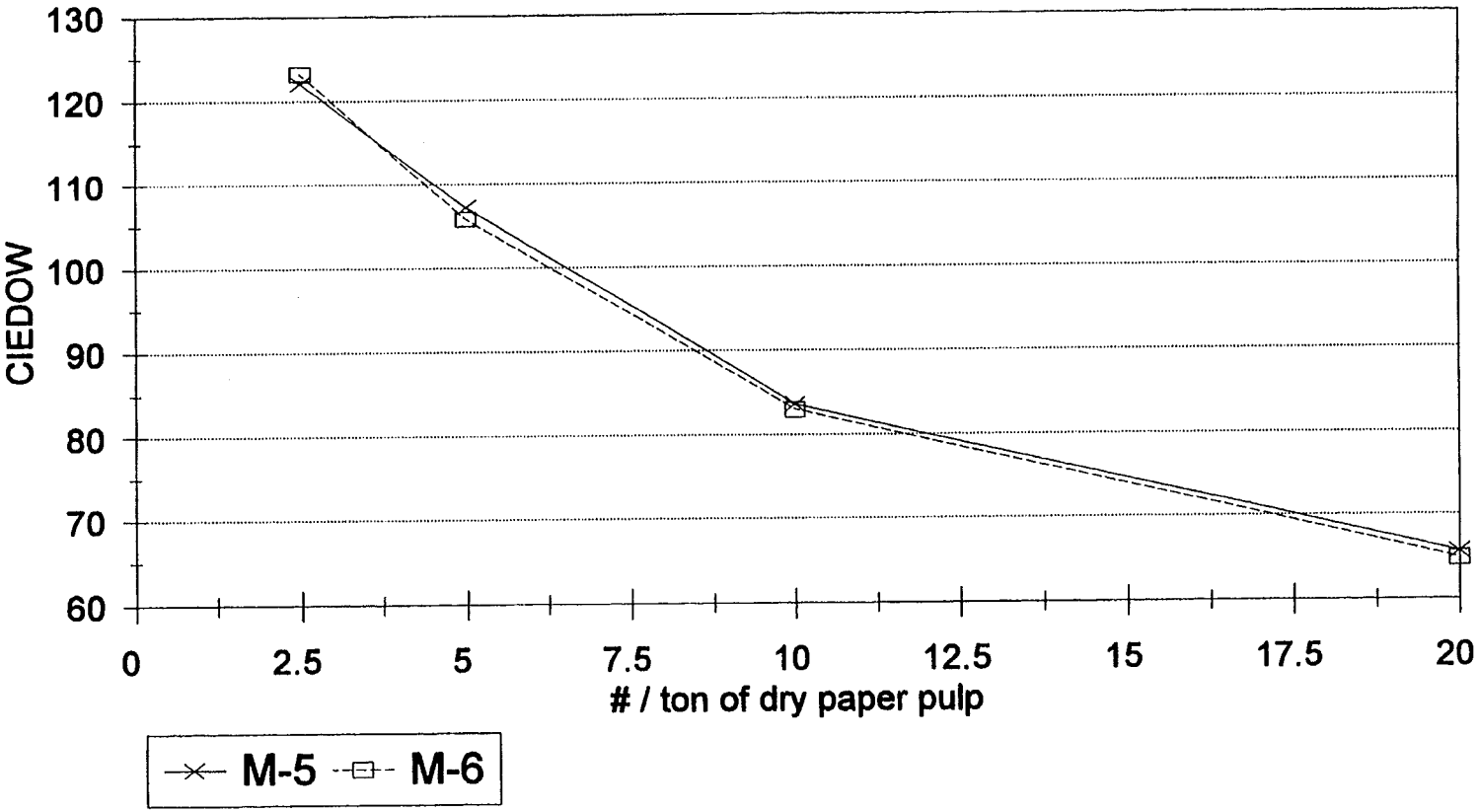
FIG. 3 illustrates comparative data of the degree of whiteness and the dosage levels of compositions according to the invention wherein the compositions include an organic acid or an inorganic acid.

The results of Table 2 are indicated on accompanying FIG. 3 which illustrates the relative efficacies of the inventive compositions comprising on the one hand mineral acid, on the other an organic acid. With reference to FIG. 5, it is to be observed that the compositions according to Examples M-5 and M-6 exhibit comparable quenching ability at the same dosage levels.

IV. Evaluation of Compositions M-6, M-8, M-9, M-10, M-11 and M-12

Plural evaluative samples were made in accordance with the general procedure outlined above under the heading "Production of Paper Samples" utilizing the aqueous compositions according to Compositions M-6, M-8, M-9, M-10, M-11 and M-12 Comparative samples were also evaluated which included Constituent (a), Constituent (b) and a control sample (referred to as "Control"). The control sample was a paper feedstock which contained no optical brightener but in other respects was the same as that used in the other compositions evaluated. The evaluation was performed to compare the performance of the comparative samples relative to compositions according to the invention as well as evaluating compositions according to the invention differing relative weight proportions of Constituent (a) and Constituent (b). Varying dosages of quenching compositions of the compositions were evaluated. These dosage levels were weight percentage levels equivalent to 2.5, 5, 10 and 20, 30 and 40 lbs. of the aqueous quenching composition per ton dry paper pulp. Testing procedures were carried out in accordance with the protocol outlined under the headings "Production of Paper Samples" and "Evaluation of Paper Samples" to determine the efficacy of the inventive composition under alkaline process conditions in the range of pH 7–8½; the results of these evaluations are outlined in Table 4 below.

TABLE 4

| | relative weight ratio Const. (a): Const (b) | 0 lbs. Composition per ton dry pulp: | 2.5 lbs. Composition per ton dry pulp: | 5 lbs. Composition per ton dry pulp: | 10 lbs. Composition per ton dry pulp: | 20 lbs. Composition per ton dry pulp: | 30 lbs. Composition per ton dry pulp: | 40 lbs. Composition per ton dry pulp: |
|---|---|---|---|---|---|---|---|---|
| Composition: | | CIEDOW | | | | | | |
| Control: | | 72.89 | 72.89 | 72.89 | 72.89 | 72.89 | 72.89 | 72.89 |
| Const. (a): | 1:0 | 134.69 | 126.67 | 118.87 | 108.61 | 89.75 | 77.19 | 71.9 |
| M-12 | 6:1 | 136.26 | — | — | 106.33 | 80.9 | 69.3 | 64.73 |
| M-11 | 5:1 | 136.26 | — | — | 104.69 | 78.33 | 68.72 | 62.73 |
| M-10: | 3:1 | 134.69 | 127.22 | 117.29 | 98.3 | 75.89 | 66.88 | 63.96 |
| M-6: | 1:1 | 134.69 | 125.49 | 111.24 | 90.61 | 74.09 | 67.12 | 66.2 |
| M-8: | 1:3 | 134.69 | 124.48 | 107.96 | 85.91 | 72.94 | 67.86 | 67.99 |
| M-9: | 1:4 | 134.69 | 123.32 | 106.28 | 87.56 | 74.47 | 69.29 | 71.31 |
| Const. (b): | 0:1 | 134.69 | 113.87 | 94.64 | 78.38 | 75.89 | 73.16 | 77.07 |

Figure 4:
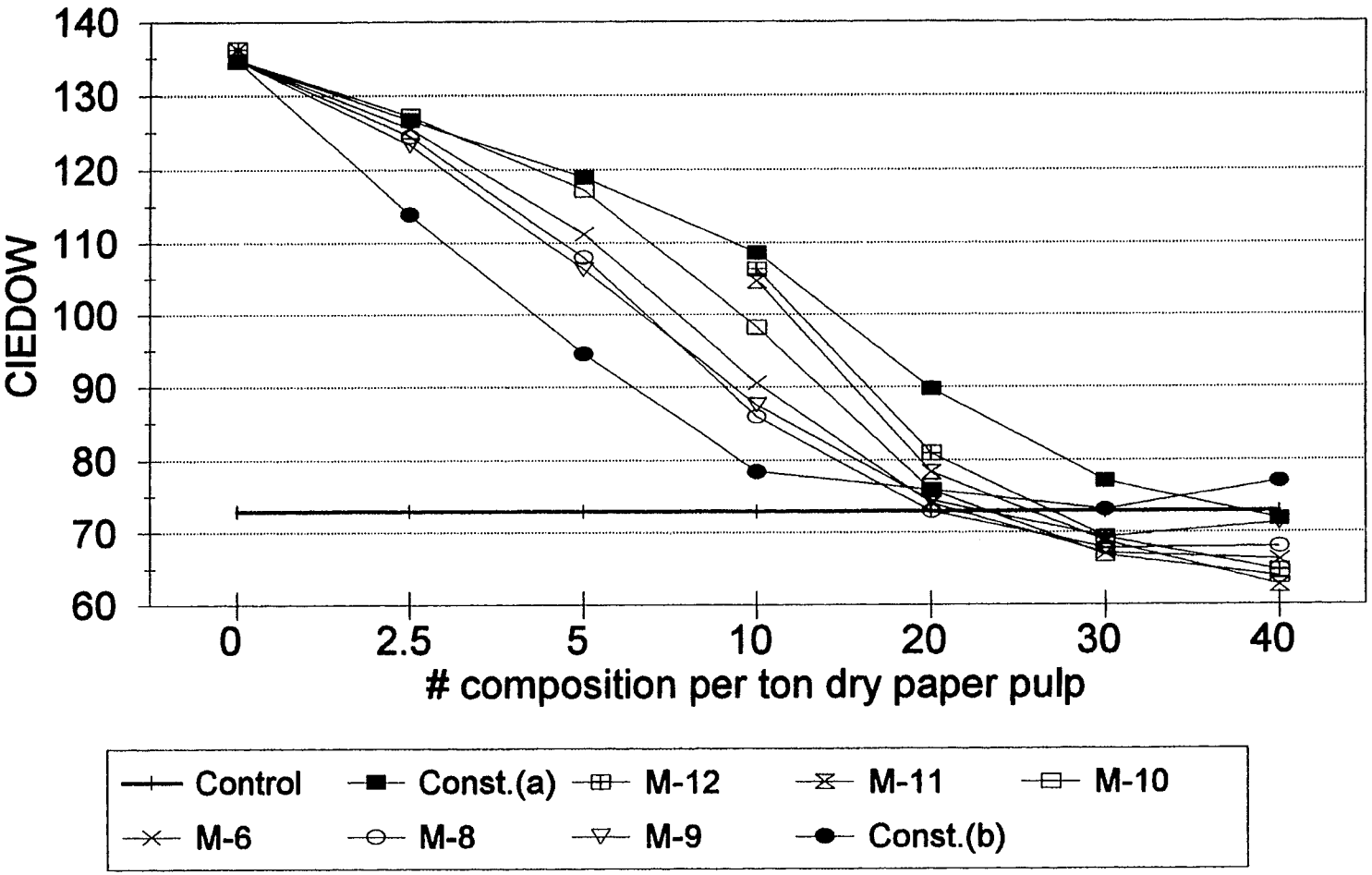
FIG. 4 illustrates comparative data of the efficacy of compositions according to the invention as well as prior art compositions wherein the compositions include an organic acid or an inorganic acid at various dosage levels and further wherein the proportions of the constituents were varied.

As is illustrated on FIG. 4, the compositions showed excellent quenching effect as compared to comparative compositions, particularly at dosage levels of approximately 20 or more pounds of aqueous composition per ton of dry paper pulp. Of these compositions those which had a weight ratio of constitutent (a):constitutent (b) of about 1 to 6:1 showed the most pronounced quenching effect, as is indicated by compositions according to M-6, M-8, M-10, M-11 and M-12. This is apparent from both Table 4 and FIG. 4 wherein these compostions provide quenching so to reduce the optically brightened paper to levels approximating the levels of the Control sample (i.e., non-optically brightened feedstock). Also it was observed that constituent (b) also exhibited increasing yellowing of the feedstock and paper formed therefrom as the dosage of constituent (b) was increased above 10 lbs. per ton of paper pulp on a dry weight basis. Constituent (a) did not exhibit an increased yellowing effect nor did the compositions according to the invention exhibit an increased yellowing effect over the dosage range evaluated. It will be appreciated that the instant specifications and examples set forth herein are by way of illustration and not limitation, and that various modifications and changes may be made without departing from the spirit and scope of the present invention, whose limitations are bounded only by the appendant claims.

I claim:

1. An aqueous composition comprising:

constituents (a) and (b)

wherein constituent (a) is (i): an acid addition salt or quartenization product of a cyclic amidine of Formula A.1

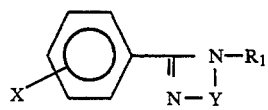

(A.1)

wherein:

Y is an alkylene chain having 2 to 4 carbon atoms, $R_1$ is hydrogen, or an alkyl, aryl and aralkyl group where such alkyl, aryl and aralkyl groups contain up to 7 carbon atoms, X is hydrogen, or a radical of Formula A.2:

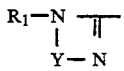

(A.2)

wherein $R_1$ and Y are as above defined, or constituent (a) may be:

ii): an acid addition salt or quartenization product of a polycondensation product containing two or more units which correspond to the compound of Formula A.3:

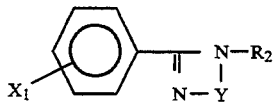

(A.3)

wherein Y is as defined above, $R_2$ is an alkylene chain with up to 8 carbon atoms and $X_1$is selected from the group consisting of:

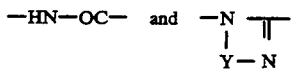

wherein

Y is as above defined and, constituent (b)which is a polyethyleneimine polymer or salt thereof, wherein the weight ratio of constituent (a):constituent (b) is in the range of from 10:1 to 1:3.

2. An aqueous composition according to claim 2 wherein: constituent (a) is as defined in Formula A.3 wherein $X_1$ is

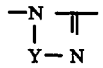

and wherein Y is ethylene.

3. An aqueous composition according to claim 1 wherein constituent (b) is a polyethyleneimine polymer having the general structure according to Formula B.1:

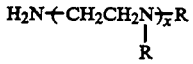

(B.1)

wherein x is 100–1,000,000, and each R is independently hydrogen or a structure according to the Formula B.2:

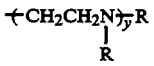

(B.2)

wherein y is 1–1,000,000 and each R is independently as above defined.

4. The aqueous composition according to claim 3 wherein the (b) polyethyleneimine polymer has a value of x in the range 250–250,000.

5. The aqueous composition according to claim 1 where the weight ratio of constituent (a):constituent (b) is in the range of from 8:1 to 1:2.

6. The aqueous composition according to claim 5 where the weight ratio of constituent (a): constituent (b) is in the range of from 6:1 to 1:1.5.

7. The aqueous composition according to claim 6 where the weight ratio of constituent (a): constituent (b) is in the range of from 5:1 to 1:1.

8. A process aid preparation for the quenching of fluorescent brighteners which comprises: an aqueous mixture of constituents (a), (b) and (c);

wherein constituent (a) is (i): an acid addition salt or quartenization product of a cyclic amidine of Formula A.1

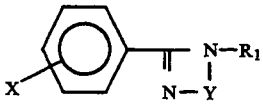

(A.1)

wherein:

Y is an alkylene chain having 2 to 4 carbon atoms, $R_1$ is hydrogen, or an alkyl, aryl and aralkyl group where such alkyl, aryl and aralkyl groups contain up to 7 carbon atoms, X is hydrogen, or a radical of Formula A.2:

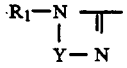

(A.2)

wherein $R_1$ and Y are as above defined, or, ii): an acid addition salt or quartenization product of a polycondensation product containing two or more units which correspond to the compound of Formula A.3:

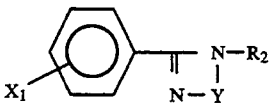

(A.3)

wherein Y is as defined above, $R_2$ is an alkylene chain with up to 8 carbon atoms and $X_1$ is selected from the group consisting of:

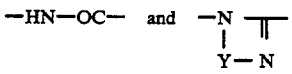

wherein

Y is as above defined, constituent (b) is a polyethyleneimine polymer or a cationic, anionic, or amphoteric salt thereof where the polyethyleneimine polymer has the general structure according to Formula B.1:

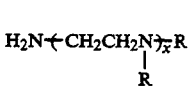

(B.1)

wherein x is 100–1,000,000, and each R is independently hydrogen or a structure according to the Formula B.2:

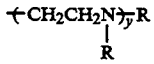

(B.2)

wherein y is 1–1,000,000 and each R is independently as above defined, and constituent (c) is an organic or inorganic acid, wherein constituent (c) is present in an amount sufficient to form a solution of components (a) and (b) in water.

9. A process aid preparation according to claim 8 wherein constituents (a) and (b) are present in the process aid preparations in the range of from 1% to 85% by weight.

10. A process aid preparation according to claim 9 wherein: constituent (a) is as defined in Formula A.3 wherein $X_1$ is

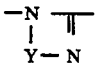

and wherein Y is ethylene.

11. A process aid preparation according to claim 9 wherein the weight ratio of constituent (a):constituent (b) is in the range of from 10:1 to 1:3.

12. A process aid preparation according to claim 11 wherein the weight ratio of constituent (a):constituent (b) is in the range of from 8:1 to 1:2.

13. A process aid preparation according to claim 12 wherein the weight ratio of constituent (a):constituent (b) is in the range of from 6:1 to 1:1.5.

14. A process aid preparation according to claim 13 wherein the weight ratio of constituent (a):constituent (b) is 3:1.

15. A process aid preparation according to claim 13 wherein the weight ratio of constituent (a) : constituent (b) is in the range of from 2: 1.

16. A process aid preparation according to claim 8 wherein the process aid preparation has a pH in the range of from 2 to 10.

17. A process aid preparation according to claim 16 wherein the process aid preparation has a pH in the range of from 3 to 8.

18. A process aid preparation according to claim 17 wherein the process aid preparation has a pH in the range of from 4 to 6½.

19. A process for the quenching of fluorescent brighteners in an aqueous paper feedstock which comprises the process step of:

co-adding to an aqueous paper feedstock containing at least one optical brightener a component (a) which is (i):an acid addition salt or quartenization product of a cyclic amidine of Formula A.1

(A.1)

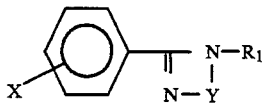

wherein:

Y is an alkylene chain having 2 to 4 carbon atoms, $R_1$ is hydrogen, or an alkyl, aryl and aralkyl group where such alkyl, aryl and aralkyl groups contain up to 7 carbon atoms, X is hydrogen, or a radical of Formula A.2:

(A.2)

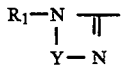

wherein $R_1$ and Y are as above defined, or constituent (a) may be:

ii):an acid addition salt or quartenization product of a polycondensation product containing two or more units which correspond to the compound of Formula A3:

(A.3)

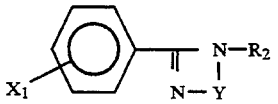

wherein Y is as defined above, $R_2$ is an alkylene chain with up to 8 carbon atoms and $X_1$ is selected from the group consisting of:

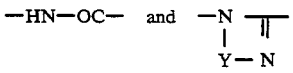

wherein

Y is as above defined and, and a component (b) which is a polyethyleneimine polymer or a cationic, anionic, or amphoteric salt thereof where the polyethyleneimine polymer has the general structure according to Formula B.1:

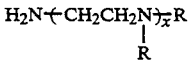

(B.1)

wherein x is 100–1,000,000, and each R is independently hydrogen or a structure according to the Formula B.2:

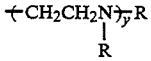

(B.2)

wherein y is 1–1,000,000 and each R is independently as above defined, wherein the components (a) and (b) are co-added in amounts such that the weight ratio of component (a):-component (b) is in the range of from 10:1 to 1:3.

20. A process according to claim 19 wherein: component (a) is as defined in Formula A.3 wherein $X_1$ is

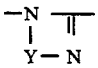

and wherein Y is ethylene.

21. A process according to claim 19 wherein the components (a) and (b) are co-added in amounts such that the weight ratio of component (a):component (b) is in the range of from 8:1 to 1:2.

22. A process according to claim 19 wherein the components (a) and (b) are co-added in amounts such that the weight ratio of component (a): component (b) is in the range of from 6:1 to 1:1.5.

23. A process according to claim 19 wherein the aqueous paper feedstock has a neutral or alkaline pH prior to the addition of component (a) or component (b).

24. A process for the quenching of fluorescent brighteners in an aqueous paper feedstock which comprises the process step of:

contacting the feedstock at a neutral or alkaline pH with an effective quenching amount of a composition according to claim 1.

25. A flushing process for use in conjunction with paper production apparatus for quenching fluorescent brighteners which process comprises the step of introducing a composition according to claim 1 into said paper production apparatus wherein no paper feedstock is present.

26. A flushing process for quenching optical brighteners in a paper production apparatus which comprises the step of:

introducing a composition according to claim 8 into said paper production apparatus wherein no paper feedstock is present.

* * * * *